United States Patent [19]

Ikeda et al.

[11] Patent Number: 4,789,311

[45] Date of Patent: Dec. 6, 1988

[54] SWASH PLATE TYPE COMPRESSOR

[75] Inventors: Hayato Ikeda; Kazuaki Iwama; Satoshi Kitahama, all of Kariya, Japan

[73] Assignee: Kabushiki Kaisha Toyoda jidoshokki Seisakusho, Kariya, Japan

[21] Appl. No.: 134,003

[22] Filed: Dec. 17, 1987

[30] Foreign Application Priority Data

Dec. 26, 1986 [JP] Japan ..... 61-203441[U]

[51] Int. Cl.[4] ..... F04B 27/08; F01B 3/00; F16H 23/00

[52] U.S. Cl. ..... 417/269; 92/71; 74/60

[58] Field of Search ..... 417/269; 74/60; 92/71; 91/502; 123/58 AB, 58 B, 58 BB

[56] References Cited

U.S. PATENT DOCUMENTS 3,938,397 2/1976 Rasmussen ..... 417/269 X
4,364,306 12/1982 Hattori et al. ..... 417/269 X
4,470,761 9/1984 Mukai et al. ..... 417/269

FOREIGN PATENT DOCUMENTS 24304 2/1979 Japan ..... 417/269

*Primary Examiner*—Paul F. Neils
*Attorney, Agent, or Firm*—Brooks Haidt Haffner & Delahunty

[57] ABSTRACT

A swash plate type refrigerant compressor having a swash plate supported on a rotatable drive shaft, a plurality of double-headed pistons engaged with the swash plate so as to be reciprocated in cylinder bores of the compressor is disclosed herein. The swash plate has formed round and throughout its circumferential periphery an annular groove. An annular ring member is received in the groove, said ring member having an outer diameter larger than the diameter of said swash plate and forming with the bottom annular surface of said groove a substantially annular clearance at least during the operation of the compressor.

9 Claims, 6 Drawing Sheets

PRIOR ART

PRIOR ART

SWASH PLATE TYPE COMPRESSOR

FIELD OF THE INVENTION

The present invention relates generally to a swash plate type compressor adapted for use in an automotive air conditioning system.

BACKGROUND OF THE INVENTION

For the sake of better understanding of a prior art swash plate type compressor to which the present invention is relevant, reference is had to FIGS. 8 and 9 of the drawings accompanying herewith, showing a piston 92 and its position relative to a swash plate 90, respectively, in the prior art swash plate type refrigerant compressor incorporated in an automotive air conditioning system. The piston 92 has a pair of head portions 92*a* at its opposite ends connected integrally by its intermediate neck portion 92*b*, as shown in FIG. 8, and fitted slidably in a cylinder bore 91, as shown in FIG. 9. In operation, the swash plate 90 is driven to rotate in the arrow direction designated by symbol P, making a wobbling movement so as to impart a reciprocating motion to the piston 92 by way of conventional shoes 93 (only one being shown) interposed between the opposite inclined surfaces of the swash plate 90 and the inner ends of the piston heads 92*a*, respectively.

As shown clearly in FIG. 9, the neck portion 92*b* of the piston 92 has a pair of surfaces 92*c* which are formed with such an inclination that each of such surfaces substantially conform to the curvature of the circumferential peripheral surface 90*a* of the circular swash plate 90 in confrontation therewith with a clearance C provided between such inclined surface 92*c* and the swash plate peripheral surface 90*a*. Thus, the axial rotation of the piston 92 is regulated. However, such a swash plate type compressor poses a problem as will be described below.

In general, the piston 92 is susceptible to the movement in arrow direction R under the influence of the rotation of the swash plate 90 which is transmitted via the shoe 93 to the piston, thereby the piston 92 being caused to move a slight distance allowed by the aforementioned clearance C until the inclined surface 92*c* on the side downstream with respect to the direction R is brought into contact with the swash plate peripheral surface 90*a*.

In the early period of a suction stroke, or just after the completion of a compression stroke, of one piston head 92*a* of the double-headed piston 92, the pressure in the cylinder bore 91 is relatively low and, therefore, there is a tendency of the piston 92 making the slight movements in the arrow direction R and counter arrow direction alternately while allowing its inclined surfaces 92*c* to be rebounded by the peripheral surface 90*a* of the swash plate 90 which is rotated with a high magnitude of kinetic energy.

Both inclined surfaces 92*c* of the piston 92 thus hit against the swash plate peripheral surface 90*a* alternately, causing not only continuous impact noise but also harmful wear on the inclined surfaces 92*c* of the piston and/or the swash plate peripheral surface 90*a*.

On the other hand, in the later period of a compression stroke, when the piston head 92*a* approaches its top dead center and, therefore, a high pressure prevails in the cylinder bore 91, the piston 92 tends to be held in its slightly rotated position without rebounding, with one surface 92*c* of the piston 92, or the surface on the right-hand side as viewed in FIG. 9, placed in strong pressing contact with the circumferential peripheral surface 90*a* of the rotating swash plate 90. Thus, the swash plate peripheral surface 90*a* is subjected to the scratching action by the edge of the inclined surface 92*c* of the piston 90 which may cause damage to the swash plate surface 90*a*.

SUMMARY OF THE INVENTION

It is an object of the present invention, therefore, to provide a swash plate type refrigerant compressor which can remove the above problems found in conventional compressors of swash plate type.

In a swash plate type compressor constructed in accordance with the present invention, its swash plate is formed round its circumferential periphery an annular groove for receiving therein a ring member which is so sized that its outer diameter is greater than that of the swash plate and also that, at least during the operation of the compressor, its inner diameter is greater than the diameter of a circle described by the bottom surface of the annular groove of the swash plate in rotation so that an annular clearance may be formed between the ring member and the bottom annular surface of the groove when the former is placed in concentric relation to the swash plate.

The provision of such ring member can not only prevent direct contact of the surfaces of the piston, such as the inclined surfaces as referred to in the description of the prior art, with the circumferential periphery of the swash plate, but also serve to absorb or dampen the shock of impact produced when the above surfaces of the piston contact with the ring member, thus minimizing the shock to be transmitted to the swash plate.

These and other objects, features and advantages of the invention will become apparent to those skilled in the art from the following description of a preferred embodiment of the compressor according to the present invention, which description is made with reference to the accompanying drawing.

DETAILED DESCRIPTION OF THE PREFERRED EMBODIMENT

Figure 1:
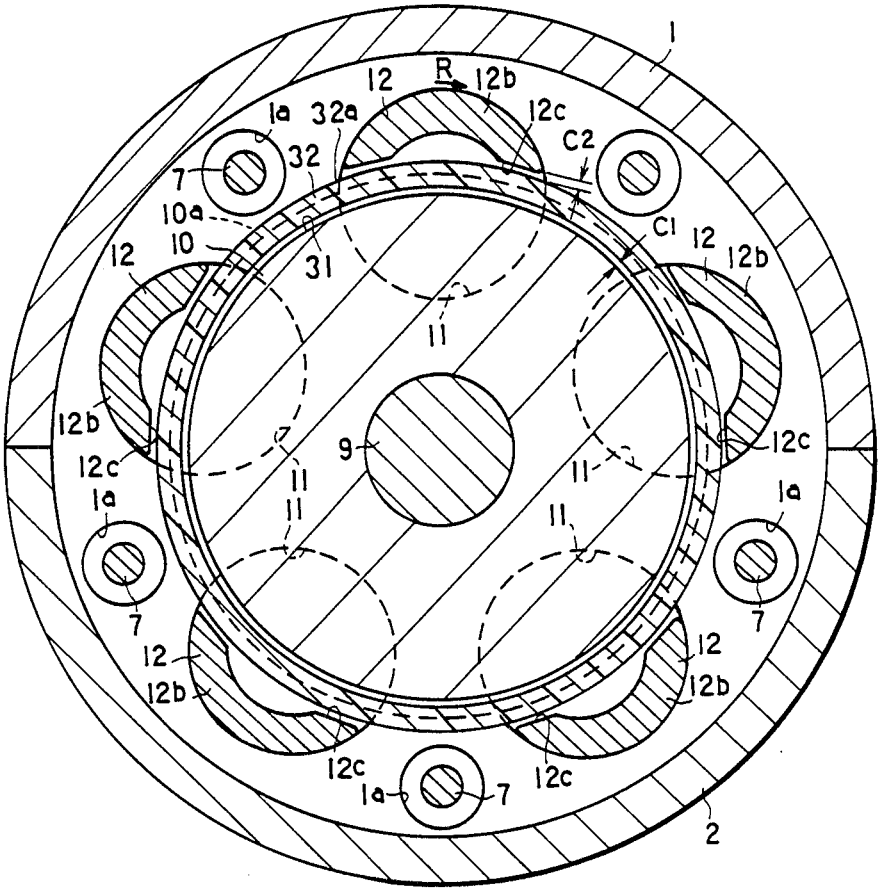
FIG. 1 is a cross-section taken along line A—A in FIG. 2, showing the preferred embodiment of swash plate type compressor having a ring member incorporated therein according to the present invention.
Figure 2:
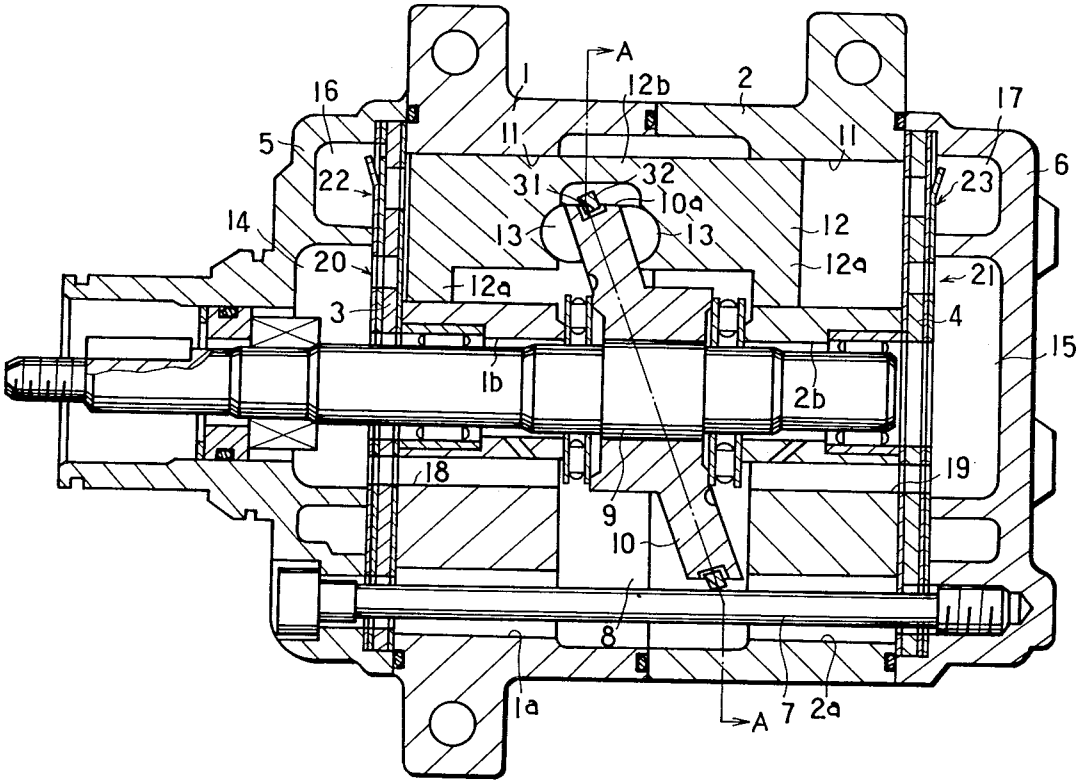
FIG. 2 is a vertical cross-section taken substantially along the center of the compressor of FIG. 1.

Referring to FIGS. 1 and 2, there is shown a swash plate type refrigerant compressor constructed in accordance with the present invention. The compressor includes front and rear cylinder blocks 1, 2 sealingly connected in axial alignment with each other. The front cylinder block 1 has at its outer front end a front housing 5 sealingly clamped thereto with a valve plate 3 interposed between the cylinder block 1 and the housing 5. Similarly, the rear cylinder block 2 has at its outer rear end a rear housing 6 sealingly clamped thereto with a valve plate 4 interposed between the cylinder block 2 and the housing 6. All these cylinder blocks 1, 2, housings 5, 6 and valve plates 3, 4 are secured together by means of a plurality of bolts 7 extending through passages 1*a*, 1*b* formed in the front and rear cylinder blocks 1, 2, respectively. The front and rear cylinder blocks 1 and 2 cooperate to form therein a compartment 8 for accommodating a circular swash plate 10 which is fixedly mounted with a predetermined inclination on a drive shaft 9 which is in turn received in central axial bores 1*b*, 2*b* formed in alignment in the cylinder blocks 1, 2 and supported rotatably by bearings pressed in such bores, respectively.

The swash plate 10 has formed round and throughout its circumferential periphery 10*a* a channel-shaped annular groove 31 for receiving therein an annular ring member 32 having substantially a square shape in cross section.

As shown clearly in FIG. 1, the ring member 32 is formed as a complete ring having no break in it and made of any suitable synthetic resin material. The ring member 32 is so sized that its outer diameter is greater than that of the swash plate 10 and also that its inner diameter e.g. under a room temperature is greater than the diameter of a circle defined by the bottom surface of the annular groove 31 so that a clearance C1 may be formed between the ring member 32 and the bottom surface of the groove 31 when the ring member is placed in substantially concentric relation to the circular swash plate 10. That is, the inner diameter of the ring member 32 is such that the clearance C1 may be formed uniformly throughout the circumference between the groove bottom surface and the ring member 32, as shown in FIG. 1, under the influence of centrifugal force created by the rotating swash plate during operation of the compressor.

The cylinder blocks 1 and 2 have formed therein a desired number of aligned paired cylinder bores 11, e.g. five pairs in the illustrated embodiment as clearly seen in FIG. 1, said pairs being equally angularly spaced around and in parallel to the drive shaft 9. As shown in FIG. 2, each pair of the aligned cylinder bores 11 receives a double-headed or double-acting piston 12 for reciprocal sliding movement therein. The piston 12 is cut at its intermediate portion to provide a pair of piston heads 12*b* on opposite ends thereof and a neck portion 12*b* intermediate the head portions. The drive shaft 9 carries the swash plate 10 in such a way that the latter can make a wobbling movement in the swash plate compartment 8 while rotating with the drive shaft 9. Each piston head 12*a* is held to the inclined surface of the swash plate 10 by way of a hemispherical shoe 13 in such a way that the wobbling movement of the plate may be converted into the reciprocating motion of each piston 5. Thus, each piston head 12*a* cooperates with its associated cylinder bore 11 to form a working or compression chamber into which a refrigerant gas is introduced in suction stroke and out of which the compressed gas is discharged in discharge stroke of the compressor. As shown clearly in FIG. 1, the neck portion 12*b* of the piston 12 has a cross section like the letter "C" and each of surfaces 12*c* of a pair on each neck portion 12*b* are formed with such an inclination that each such surface substantially conforms to the curvature of the circumferential periphery of the ring member 32 in confrontation therewith with a clearance C2 provided between the inclined surface and the outermost edge of the ring member 32 so as to allow the swash plate 10 to rotate in the compartment 8 while regulating the axial rotation of the piston 12.

The front housing 5 has at its center formed a suction chamber 14 and at its outer portion a substantially annular discharge chamber 16, respectively. The suction chamber 14 communicates with the swash plate compartment 8 through a plurality of suction passages 18 each formed between any two adjacent cylinder bores 11. Likewise, the rear housing 6 has formed therein a suction chamber 15 and a discharge chamber 17, respectively, and the suction chamber 15 communicates with the swash plate compartment 8 through a plurality of suction passages 19 each formed between any two adjacent cylinder bores 11.

The front valve plate 3 includes suction valves 20 for allowing refrigerant gas into the associated cylinder bores 11 from the suction chamber 14 and also discharge valves 22 for allowing the refrigerant gas compressed in the cylinder bores to be discharged out into the discharge chamber 16, respectively. Similarly, rear valve plate 4 includes suction valves 21 for allowing refrigerant gas into the associated cylinder bores 11 from the suction chamber 15 and discharge valves 23 for allowing the compressed refrigerant gas to be discharged out into the discharge chamber 17, respectively.

The following will describe the operation of the compressor thus constructed.

In operation of the compressor, the swash plate 10 is driven by the drive shaft 9, while making a wobbling motion to cause the pistons 12 to reciprocate in their cylinder bores 11, whereby suction and compression of a refrigerant gas and the subsequent discharging of the compressed gas are performed repeatedly in a known way. Since the manner in which the refrigerant gas flows in the compressor is very well known and it is not the subject of the present invention, no further description will be made with regards to the flow of the refrigerant gas in the compressor.

Figure 8:
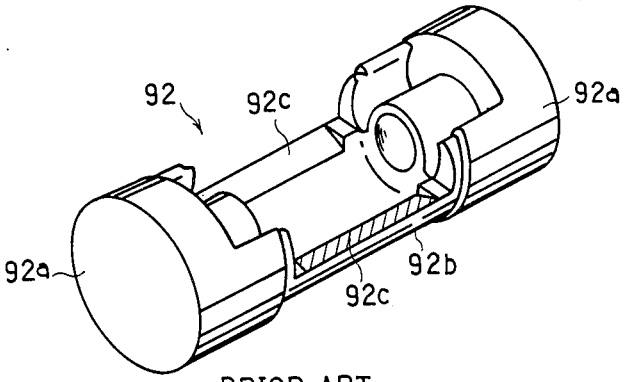
FIG. 8 is a perspective view showing a double-headed piston used in a swash plate type compressor.
Figure 9:
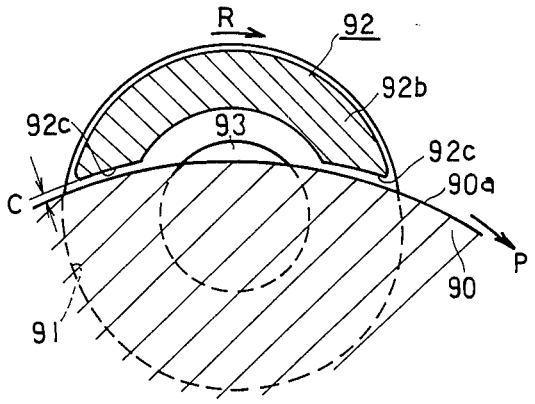
FIG. 9 is a cross-sectional view showing relative positions of the piston of FIG. 8 to swash plate in a conventional swash plate type compressor.

In the early period of a suction stroke of one piston head 12*a* of the double-headed piston 12 when the refrigerant gas pressure in the associated cylinder bore 11 is relatively low, the piston 12 tends to make alternate movements in opposite directions for a small distance allowed by the clearance C2, as described earlier with reference to the prior art of FIGS. 8 and 9.

Unlike the case with the prior art compressor, however, harmful contact of the inclined surfaces 12*c* of the piston 12 with the peripheral surface 10*a* of the swash plate 10 can be avoided because of the provision of the ring member 32 round the circumferential periphery 10*a* of the swash plate 10, and the surfaces 12*c* are moved alternately into contact with the swash plate outermost peripheral edge 32*a*.

Furthermore, because the ring member 32 when subjected to the influence of centrifugal force created by the rotating swash plate 10 tends to maintain the aforementioned clearance C1 uniformly round the periphery of the swash plate 10, the shock of impact produced when the surfaces 12*c* contact with or hit the ring member 32 can be absorbed by the clearance. Thus, the clearance C1 serves to prevent the shock of impact from being transmitted to the swash plate 10. Additionally, the phenomenon of the rebounding of the surfaces 12c of the piston 12 can be reduced by the damping or shock absorbing effect by the clearance C1.

In this way, the compressor having the ring member 32 round the circumferential periphery of the swash plate 10 can eliminate the noise produced by direct contact between the surfaces 12c of the piston 12 and the peripheral surface 10a of the swash plate, thus substantially reducing the overall level of noise development from the compressor.

In the later period of a compression stroke when the piston head 42a approaches its top dead center, the piston 12 tends to remain its slightly rotated position because of the refrigerant gas under a high pressure then prevailing in the associated cylinder bore 11, with one inclined surface 12c, or the surface on the side downstream with respect to the rotational direction of the swash plate 10, placed in pressing contact with the ring member 32. However, the ring member 32 which tends to maintain the clearance C1 under the influence of centrifugal force of the rotating swash plate 10 acts against such pressing of the piston surface 12c. Even if the clearance C1 is reduced to zero by a strong pressure from the piston surface 12c, the ring member 32 is merely pressed down against the bottom surface of the groove 31, having a sliding contact therewith. Thus, the ring member 32 can avoid the scratching contact with the surface 12c. As a matter of course, the circumferential periphery of the swash plate 10 is free from the scratching action by the edge of the piston surface 12c and, therefore, the durability of the swash plate can be improved greatly.

It is to be understood that the present invention is not limited to the above-described specific embodiment, but it may be provided in various changes and modifications without departing from the spirit of the invention. The following will describe some of such changes in accordance with the invention.

Figure 3:
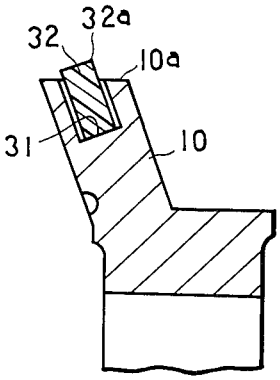
FIGS. 3 through 6 are cross-sectional views showing modified forms of ring members according to the present invention.

The ring member 42 shown in FIG. 3 is made of a synthetic resin in the form of a complete ring having therein no cut, and sized such that its inner diameter under a room temperature may be substantially equal to the diameter of a circle defined by the bottom surface of the groove 41, thus having no clearance formed therebetween. In operation, the ring member 42 is expanded by the heat produced, e.g. by sliding contact of the piston with the cylinder bores, at a rate greater than the iron swash plate 10 is expanded, so that a clearance is formed in operation between the ring member 42 and the bottom surface of the groove 41. It is to be noted that, for achieving the intended effect of the invention, the ring member may be formed in any way, provided that a clearance as exemplified by C1 in the embodiment of FIGS. 1 and 2 is formed during the compressor operation under a working temperature.

Figure 4:
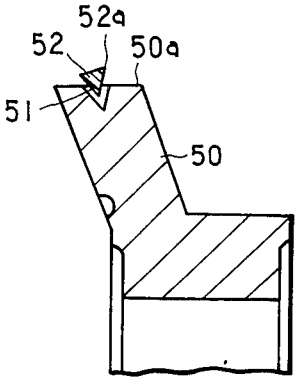
Figure 5:
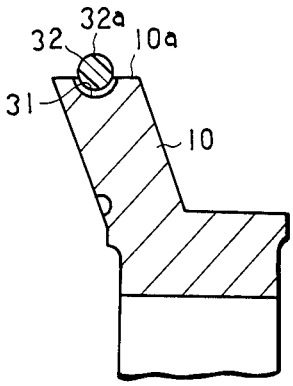

Though the ring member 32 of FIGS. 1 and 2 has a rectangular shape in cross section, it may be formed other than such shape, e.g. a triangle shape 52 as shown in FIG. 4 and a circular shape 62 as shown in FIG. 5. Their mating grooves 51 and 61 are formed so as to conform to the cross section of the ring members 52 and 62, respectively. To improve the durability of the ring member, it should be formed preferably with a cross section that can provide a smooth contact between the ring member and the inclined surfaces on the piston, or a larger area of contact therebetween.

The ring member may be made of various materials other than the synthetic resin as in the embodiment of FIGS. 1 and 2. It may be made of materials such as metals; inorganic materials, e.g. as ceramics; composite materials, e.g. fiber-reinforced synthetic resins, etc. Synthetic resins for the ring member can offer an advantage in lightweightness and vibration damping, while the metals are advantageous in terms of durability. Metals such as cast irons or vibration damping alloys can provide the damping capability, as well.

Figure 6:
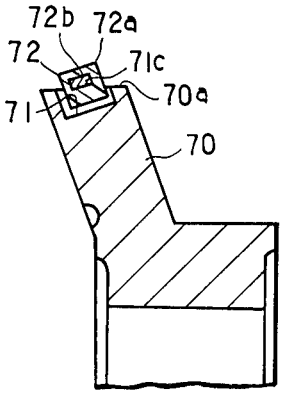

FIG. 6 shows a further modified ring member 72 including an outer wrapping portion 72b made of a synthetic resin and core portion 72c made of a metal. In so constructing, the advantages of both the synthetic resin and metal materials are obtainable.

Figure 7:
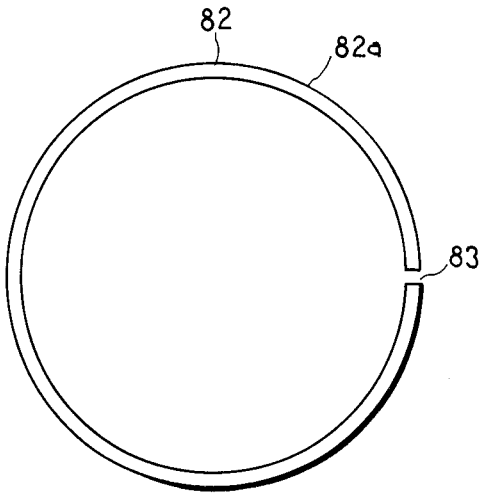
FIG. 7 is a front view of a ring member of further modified embodiment of the invention.
Figure 7A:
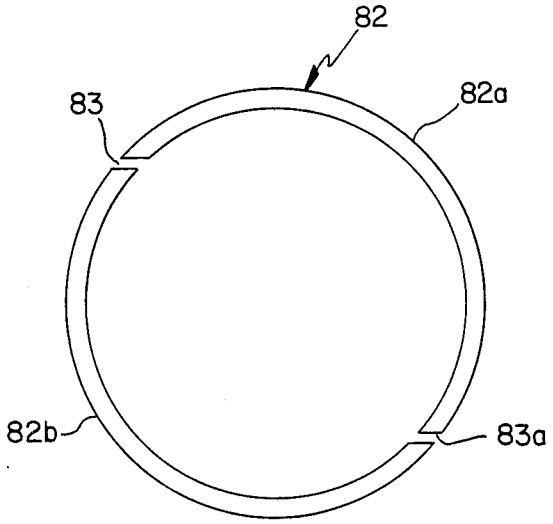
FIG. 7A is a similar view of a modified form of ring member.

FIG. 7 exemplifies a ring member 82 having a cut 83 in it. This ring member 82, when subjected to the influence of centrifugal force of the swash plate, can expand thereby not only to provide the desired clearance between the ring member and the bottom surface of the groove in which it is fitted, but also to make possible sliding thereof in constant contact with the inclined surfaces of the piston so that the aforementioned slight rotation per se of the piston can be regulated. Though the shown ring member 82 has only one cut 83, as shown in FIG. 7A it may be formed by a plurality of arc-shaped pieces 82a, 82b so that two or more cuts 83, 83a are provided when the ring member is set properly within the groove in the circumferential periphery of the swash plate. It is noted that, for such ring members having therein at least one cut, they should preferably be made of a highly durable metal material.

While the invention has been described and illustrated specifically with reference to the desired embodiment and other possible modifications, it is to be understood that the invention can be changed or modified in various other ways without departing from the spirit or scope thereof.

What is claimed is:

1. A swash plate type refrigerant compressor comprising:

a pair of axially combined front and rear cylinder blocks forming therein a plurality of cylinder bores and a swash plate compartment, a pair of front and rear housings arranged at axial ends of said combined cylinder blocks, each housing having therein a suction chamber and a discharge chamber, valve plates interposed between said front and rear housings and said axial ends of said combined cylinder blocks, respectively, a drive shaft extending axially through said swash plate compartment of said combined cylinder blocks, a swash plate in said swash plate compartment supported on said drive shaft and rotatable therewith, a plurality of double-headed pistons engaged with said swash plate so as to be reciprocated in said cylinder bores, each piston having a pair of head portions at the opposite ends thereof connected together by an intermediate portion of said piston, said swash plate having formed on and throughout its circumferential periphery an annular groove, an annular ring member received in said annular groove, said ring member having an outer diameter larger than the diameter of said swash plate and forming with the bottom annular surface of said groove a substantially annular clearance at least during the operation of the compressor.

2. A swash plate type refrigerant compressor according to claim 1, wherein said ring member is formed by a continuous endless ring.

3. A swash plate type refrigerant compressor according to claim 1, wherein said ring member is formed by a continuous ring having a cut therein.

4. A swash plate type refrigerant compressor according to claim 1, wherein said ring member is made of a heat expandable material and formed such that its inner circumferential periphery is in contact with the bottom surface of said groove under a room temperature, whereby said clearance is formed by expansion of said ring member when subjected to heat during the compressor operation.

5. A swash plate type refrigerant compressor according to claim 1, wherein said ring member is made of a synthetic resin.

6. A swash plate type refrigerant compressor according to claim 1, wherein said ring member is made of a metal.

7. A swash plate type refrigerant compressor according to claim 1, wherein said ring member is made of a composite material having a metal for the core portion thereof and a synthetic resin for the other portions other than said core portion.

8. A swash plate type refrigerant compressor according to claim 1, wherein said ring member is formed by at least two arc-shaped pieces, each said arc-shaped piece having an outer curvature whose diameter is larger than that of said swash plate and an inner curvature whose diameter is larger than the diameter of a circle defined by the bottom of said annular groove.

9. A swash plate type refrigerant compressor according to claim 8, wherein said arc-shaped pieces are made of a metal.

* * * * *